US005170885A

United States Patent [19]

Guenther et al.

[11] Patent Number: 5,170,885

[45] Date of Patent: Dec. 15, 1992

[54] INSULATING HOUSING STRUCTURE WITH AN IMPROVED BUSHING FOR A CONDUCTOR

[75] Inventors: Wolfgang Guenther, Munich; Ralf-Reiner Volkmar, Berlin, both of Fed. Rep. of Germany

[73] Assignee: Siemens Aktinengesellschaft, Berlin & Munich, Fed. Rep. of Germany

[21] Appl. No.: 534,744

[22] Filed: Jun. 7, 1990

[30] Foreign Application Priority Data

Jun. 19, 1989 [DE] Fed. Rep. of Germany ..... 3920355

[51] Int. Cl.[5] ..... H01H 33/66

[52] U.S. Cl. ..... 200/144 B; 174/50.63

[58] Field of Search ..... 200/144 B, 144 R; 174/50.63, 50.61, 152 GM

[56] References Cited

U.S. PATENT DOCUMENTS 3,385,618 5/1968 Hargis ..... 174/50.61

3,674,958 7/1972 Attia et al. ..... 200/144 B

OTHER PUBLICATIONS

US-Z "Electronics Industry", May 1986, p. 39.

DE-Z "Siemens Components" (1986), Issue 4, pp. 143-144).

*Primary Examiner*—Harold Broome

*Attorney, Agent, or Firm*—Kenyon & Kenyon

[57] ABSTRACT

To improve the high voltage strength of conductor bushings on an insulating housing structure, the outer surface of the housing structure is depressed all around the bushing aperture and is provided with a metallization within this depressed region. The conductor which is passed through is preferably fixed into position with a holding element, which consists of a tapered tubular piece having an annular base resting on the depressed surface and a collar-type neckpiece contacting the lead contact wire.

5 Claims, 1 Drawing Sheet

INSULATING HOUSING STRUCTURE WITH AN IMPROVED BUSHING FOR A CONDUCTOR

BACKGROUND OF THE INVENTION

The present invention relates to the field of high voltage equipment and is used in the structural development of a conductor bushing which passes through an insulating housing structure. For example, such housing structures are used for mounting an electrical contact configuration. Such a housing structure, might comprise, for example, a cup or box-shaped, glass or ceramic housing structure of a vacuum relay.

The passing of a conductor, e.g. of a metallic lead contact wire, through an insulating housing wall takes place generally in a manner such that either an annular metallization is applied all around the bushing aperture, a cap is butt soldered onto this metallization and the conductor is soldered into an aperture in the contact floor (US-Z "Electronics Industry", May 1986, page 39); or such that the housing bore is metallized and the lead contact wire, which is designed as a thin-walled tube, is soldered into the bore (DE-Z "Siemens Components" (1986), Issue 4, pp. 143/144).

SUMMARY OF THE INVENTION

An object of the invention is to improve the high voltage strength or the dielectric strength of such bushings and thus reduce the dimensions of such housing structures or raise the nominal voltage levels.

The above and other objects of the invention are achieved by an insulating housing structure having at least one conductor passing through a housing wall, the conductor being fixed into position within the region of the respective bushing aperture by a metallization comprising a soldered joint, the outer surface of the housing structure being depressed around the respective bushing aperture and being provided with an electrically conductive coating within the depressed region.

The concentrations of field strength in the surface area of the ceramic housing structure are reduced by the measures provided according to the invention, which results in a higher dielectric or high voltage strength in the region of the conductor bushing. Above all, conductive lacquers as well as metallizations may be used as electrically conductive coatings.

In order to avoid maximum edge effects between the conductive coating in the region of the depressed surface of the insulating housing structure and the outer surface of the housing structure, and thus still further increase the high voltage strength, it is advantageous to provide the side wall of the depressed region with an uncoated chamfer on the upper edge. In order to improve the manufacturing reliability of such a conductor bushing, the conductor is, for practical purposes, not directly fixed into position within the bushing aperture, but rather, it is fixed into position by means of a holding element which is soldered onto the depressed surface, whereby a metallization is to be provided as the electrically conductive coating. A holding element is particularly suited to this end which comprises a tapered tubular piece having an annular base resting on the depressed surface and a collar-type neckpiece contacting the conductor. For the purpose of geometrically delimiting the soldering surface against the wall of the depressed surface region, the depressed surface should thereby be provided with a circular channel on its rim. Incidentally, the surface of the respective bushing aperture can also be provided with an electrically conductive coating.

The invention is particularly useful in pot-type housing structures consisting of ceramic which form the arcing chamber of a vacuum relay.

BRIEF DESCRIPTION OF THE DRAWINGS

The invention will be described in greater detail in the following detailed description with reference to the drawings, in which.

DETAILED DESCRIPTION

Figure 1:
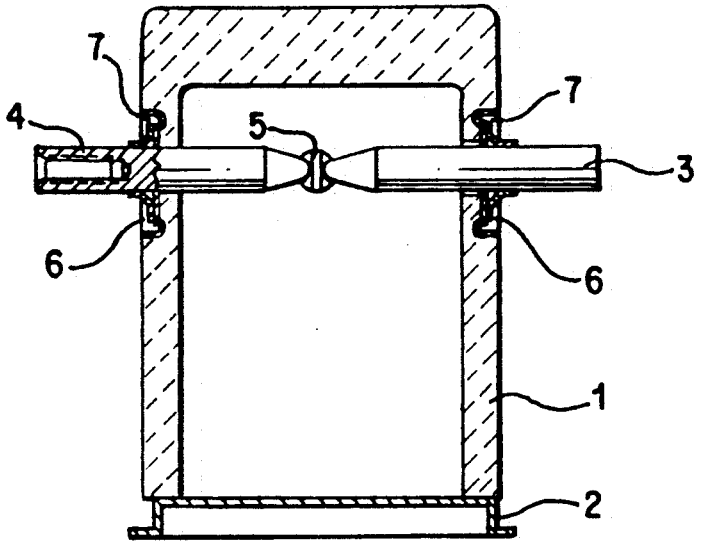
FIG. 1 shows a ceramic housing structure with three lead contact wires and a mounting support of these lead contact wires on the depressed surface parts which are provided with a circular channel.
Figure 2:
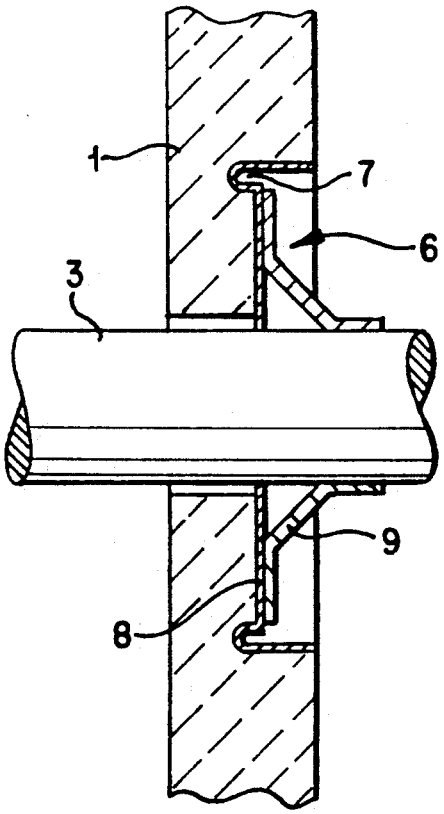
FIG. 2 is an enlarged representation of the bushing region.

FIG. 1 shows a pot-type ceramic housing structure 1, which is provided on the bottom rim with a soldered-on mounting washer 2. Three lead contact wires 3, 4 and 5 extend radially into the interior of the housing structure as conductors and comprise stationary contact assemblies at their interior disposed ends. The contact wires are prepared on their outer ends for fastening to a voltage and/or current supply. In the region of the bushing bore hole of the housing structure 1, which is now described more closely, the outer surface of the ceramic housing is depressed, or recessed whereby a depressed region 6 results. This region is provided with a groove 7 on its rim, whereby pedestal-type region is formed. The entire depressed surface is provided with a metallization 8 according to FIG. 2.

Provided respectively for fixing the lead contact wires into place is one holding element 9, which has a collar-type neckpiece contacting the lead contact wire, a tapered tubular piece and an annular base. The annular base is soldered to the metallization 8, and the collar-type neckpiece is soldered to the lead contact wire 3, 4 or 5.

Figure 3:
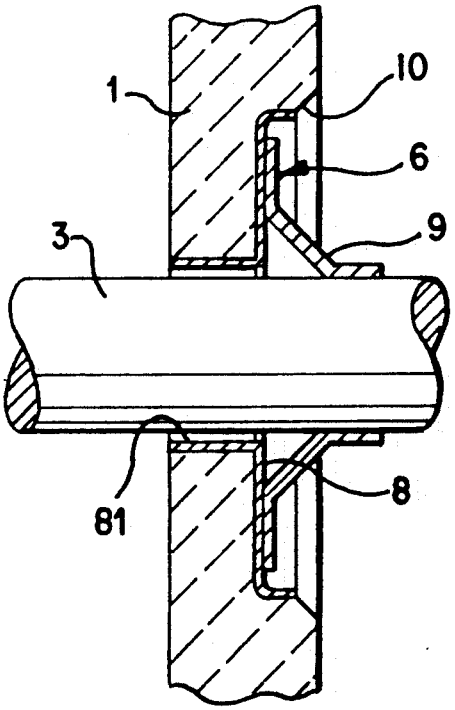
FIG. 3 is a variation of the bushing region according to FIG. 2.

According to FIG. 3, in addition to the recessed portion having the metallization and the bushing aperture can also be provided with a metallization 81. Furthermore, a chamfer 10 may be provided, which is not metallized, on the upper edge of the depressed region. In this manner, it is achieved that the voltage conducting outer edge of the metallization 8 lies below the actual surface of the ceramic housing structure, whereby concentrations of field strength are avoided within the surrounding medium, in particular air, at this critical location.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. An insulating housing structure comprising a housing wall and a bushing aperture in said housing wall adapted to have at least one conductor passing through said housing wall, said housing wall including an outer surface having a recessed region around the respective bushing aperture in said housing wall, and an electrically conductive coating disposed on wall surfaces in said recessed region, said recessed region including a side wall with an electrically conductive coating that is provided with an uncoated chamfer on an upper edge.

2. The insulating housing structure recited in claim 1, further comprising a holding element for fixing a conductor in said bushing aperture into position and wherein said electrically conductive coating comprises a metallization layer, wherein said holding element comprises a tapered tubular piece having an annular base resting on a surface of said recessed region and a collar-type neckpiece contacting the conductor.

3. The insulating housing structure recited in claim 2, wherein the recessed region has a rim and is provided with a circular channel adjacent the rim.

4. The insulating housing structure recited in claim 2, wherein the bushing aperture also includes an electrically conductive coating.

5. The insulating housing structure recited in claim 1, wherein the housing structure comprises a closed ceramic structure comprising an arcing chamber for a vacuum relay.

* * * * *